United States Patent [19]

Pham

[11] Patent Number: 5,041,368

[45] Date of Patent: Aug. 20, 1991

[54] PHOTOTHERMOGRAPHIC ELEMENTS

[75] Inventor: Oanh V. Pham, St. Paul, Minn.

[73] Assignee: Minnesota Mining and Manufacturing Company, St. Paul, Minn.

[21] Appl. No.: 535,036

[22] Filed: Jun. 7, 1990

[51] Int. Cl.[5] ..... G03C 1/494

[52] U.S. Cl. ..... 430/617; 430/600; 430/607; 430/613; 430/614; 430/919; 430/920

[58] Field of Search ..... 430/600, 607, 964, 613, 430/617, 614, 920, 919

[56] References Cited

U.S. PATENT DOCUMENTS 3,764,329 10/1973 Lee ..... 430/353
4,207,112 6/1980 Ikenoue et al. ..... 430/617
4,212,937 7/1980 Akashi et al. ..... 430/620
4,347,310 8/1982 Shiga et al. .
4,784,939 11/1988 Van Pham .

*Primary Examiner*—Charles L. Bowers, Jr.
*Assistant Examiner*—Thorl Chea
*Attorney, Agent, or Firm*—Gary L. Griswold; Walter N. Kirn; Mark A. Litman

[57] ABSTRACT

Radiation sensitive thermally developable imaging elements comprise:

(a) photosensitive silver halide,
(b) light insensitive silver salt oxidizing agent,
(c) reducing agent for silver ions, and
(d) an antifoggant or speed enhancing compound comprising iodophthalazinone compounds. The antifoggants are effective in reducing spurious background image densities.

4 Claims, No Drawings

PHOTOTHERMOGRAPHIC ELEMENTS

BACKGROUND OF THE INVENTION

1. Field of the Invention

The present invention relates to materials which reduce fog levels or increase the sensitometric speed in photothermographic imaging elements. These elements comprise a photosensitive silver halide, silver salt oxidizing agent, and reducing agent for silver ion in a binder. The antifoggants of the present invention comprise iodophthalazinone compounds.

2. Background of the Art

Silver halide photothermographic imaging materials, often referred to as "dry silver" compositions because no liquid development is necessary to produce the final image, have been known in the art for many years. These imaging materials basically comprise a light insensitive, reducible silver source, a light sensitive material which generates silver when irradiated, and a reducing agent for the silver source. The light sensitive material is generally photographic silver halide which must be in catalytic proximity to the light insensitive silver source. Catalytic proximity is an intimate physical association of these two materials so that when silver specks or nuclei are generated by the irradiation or light exposure of the photographic silver halide, those nuclei are able to catalyze the reduction of the silver source by the reducing agent. It has been long understood that silver is a catalyst for the reduction of silver ions and the silver-generating light sensitive silver halide catalyst progenitor may be placed into catalytic proximity with the silver source in a number of different fashions, such as partial metathesis of the silver source with a halogen-containing source (e.g., U.S. Pat. No. 3,457,075), coprecipitation of the silver halide and silver source material (e.g., U.S. Pat. No. 3,839,049), and any other method which intimately associates the silver halide and the silver source.

The silver source used in this area of technology is a material which contains silver ions. The earliest and still preferred source comprises silver salts of long chain carboxylic acids, usually of from 10 to 30 carbon atoms. The silver salt of behenic acid or mixtures of acids of like molecular weight have been primarily used. Salts of other organic acids or other organic materials such as silver imidazolates have been proposed, and U.S. Pat. No. 4,260,677 discloses the use of complexes of inorganic or organic silver salts as image source materials.

In both photographic and photothermographic emulsions, exposure of the silver halide to light produces small clusters of silver atoms. The imagewise distribution of these clusters is known in the art as the latent image. This latent image generally is not visible by ordinary means and the light sensitive article must be further processed in order to produce a visual image. The visual image is produced by the catalytic reduction of silver ions which are in catalytic proximity to the specks of the latent image.

U.S. Pat. No. 4,460,681 discloses a color photothermographic element in which color forming layers are separated by barrier layers to prevent migration of components between layers which would reduce the color separation.

U.S. Pat. No. 4,594,307 discloses a thermal diffusion transfer photothermographic element in which individual color sheets are used to provide colors. Multiple color images are formed by the use of multiple sheets of different colors.

Photothermographic emulsions, in a manner similar to photographic emulsions and other light sensitive systems, tend to suffer from fog. This spurious image density which appears in non-developmentally sensitized areas of the element. This is often reported in sensitometric results as $D_{min}$. This problem is also related to certain stability factors in the photosensitive elements where fog increases upon storage of the photosensitive element.

U.S. Pat. No. 4,212,937 describes the use of a nitrogen-containing organic base in combination with a halogen molecule or an organic haloamide to improve storage stability and sensitivity.

Japanese Patent Kokai JA 61-129642 published June 17, 1986 describes the use of halogenated compounds to reduce fog in color-forming photothermographic emulsions. These compounds include acetophenones including phenyl-(alpha,alpha-dibromobenzyl)-ketone.

U.S. Pat. No. 4,152,160 describes the use of carboxylic acids including benzoic acids and phthalic acids in photothermographic elements. These acids are used as antifoggants. The benzoic acids have the general formula

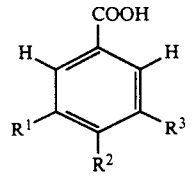

with the various substituents selected from amongst hydrogen, cyano, nitro and halogen.

U.S. Pat. No. 3,589,903 describes the use of small amounts of mercuric ion in photothermographic silver halide emulsions to improve speed and aging stability.

U.S. Pat. No. 4,784,939 describes the use of benzoyl acid compounds of a defined formula to reduce fog and to improve the storage stability of silver halide photothermographic emulsions. The addition of halogen molecules to the emulsions are also described as improving fog and stability.

BRIEF DESCRIPTION OF THE INVENTION

The use of iodophthalazinone compounds in photothermographic silver halide emulsions has been found to reduce fog and/or increase the sensitometric speed of the emulsions.

DETAILED DESCRIPTION OF THE INVENTION

The generation of fog in photoghermographic elements comprising photosensitive silver halide, organic silver salt oxidizing agent, and reducing agent for silver ion can be reduced by the addition of a fog-reducing effective amount of iodophthalazinone compounds.

The central nucleus of the iodophthalazinone compound of the present invention may be represented by the formula

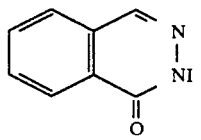

The preferred iodophthalazinone compounds of the present invention may be represented by the formula

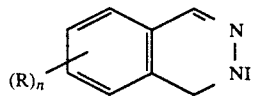

wherein each possible R substituent may be independently selected from substituents such as hydrogen, alkyl group, alkoxy group, halogen, aryl group (e.g., phenyl group, naphthyl group, thienyl group), cyano, nitro, hydroxy, and the like. n represents zero or a positive whole integer such as 1, 2, 3 or 4.

These compounds are used in general amounts of at least 0.0001 moles/mole of silver in the emulsion layer. Usually the range is between 0.005 and 0.5 moles of the compound per mole of silver and preferably between 0.001 and 0.05 moles of the compound per mole of silver.

Typically, photothermographic chemistry is prepared in a single composition with binder, and are formed in any manner which does not developmentally sensitize the silver halide in the chemistry.

Conventional silver halide photothermographic chemistry is used as the photothermographic chemistry in the system of the present invention. Such chemistry is well described in U.S. Pat. Nos. 3,457,075; 3,839,049; 3,985,565; 4,022,617 and 4,460,681. These can be either black-and-white or color chemistries. Either in situ halidization (e.g., U.S. Pat. No. 3,457,075) or preformed silver halide sources (e.g., U.S. Pat. No. 3,839,049) may be used. Any of the various photothermographic media, such as full soaps, partial soaps, full salts, and the like may be used in the photothermographic chemistry contained in the particles.

Conventional photothermographic chemistry comprises a photosensitive silver halide catalyst, a silver compound capable of being reduced to form a metallic silver image (e.g., silver salts, both organic and inorganic, and silver complexes, usually light insensitive silver materials), a developing agent for silver ion (a mild reducing agent for silver ion), and a binder. Color photothermographic systems additionally have a leuco dye or dye forming developer (alone or in combination with a developer for silver ion), or a color photographic coupler which would require a color photographic developer to be used as the developing agent for silver ion. Thus both negative and positive systems can be used.

The leuco dyes and dye forming developers which may be used in the present invention may be any colorless or lightly colored (i.e., Dmax of less than 0.2 in a concentration of 5% by weight in a 20 micron thick transparent binder layer) compound which forms a visible dye upon oxidation. The compound must be oxidizable to a colored state. Compounds which are both pH sensitive and oxidizable to a colored state are useful but not preferred, while compounds only sensitive to changes in pH are not included within the term "leuco dyes" since they are not oxidizable to a colored form.

The dyes formed from the leuco dyes in the various color-forming particles should of course be different. A difference of at least 60 nm in reflective or transmissive maximum absorbance is required. Preferably the absorbance maximum of dyes formed will differ at least 80 or 100 nm. When three dyes are to be formed, two should differ by at least these minimums, and the third should differ from at least one of the other dyes by at least 150 nm and preferably at least 200 or even at least 250 nm. This will provide a good, full color range for the final image.

Any leuco dye capable of being oxidized by silver ion to form a visible dye is useful in color forming systems of the present invention as previously noted. Dye forming developers such as those disclosed in U.S. Pat. Nos. 3,445,234; 4,021,250; 4,022,617 and 4,368,247 are useful. In particular, the dyes listed in Japanese Kohyo National Publication No. 500352/82, published Feb. 25, 1982 are preferred. Naphthols and arylmethyl-1-naphthols are generally preferred.

Conventional photothermographic chemistry is usually constructed as one or two layers on a substrate. Single layer constructions must contain the silver source material, the silver halide, the developer and binder as well as optional additional materials such as toners, coating aids and other adjuvants. Two-layer constructions must contain silver source and silver halide in one emulsion layer (usually the layer adjacent substrate) and the other ingredients in the second layer or both layers. In the present invention it is preferred to use single layer chemistry.

The silver source material, as mentioned above, ordinarily may be any material which contains a reducible source of silver ions. Silver salts of organic acids, particularly long chain (10 to 30, preferably 15 to 28 carbon atoms) fatty carboxylic acids are preferred in the practice of the present invention. Complexes of organic or inorganic silver salts wherein the ligand has a gross stability constant between 4.0 and 10.0 are also useful in the present invention. The silver source material should constitute from about 20 to 70 percent by weight of the imaging layer. Preferably it is present as 30 to 55 percent by weight.

The silver halide may be any photosensitive silver halide such as silver bromide, silver iodide, silver chloride, silver bromoiodide, silver chlorobromoiodide, silver chlorobromide, etc., and may be added to the layer in any fashion which places it in catalytic proximity to the silver source. The silver halide is generally present as 0.75 to 15 percent by weight of the particle, although larger amounts are useful. It is preferred to use from 1 to 10 percent by weight silver halide in the layer and most preferred to use from 1.5 to 7.0 percent.

The silver halide may be provided by in situ halidization or by the use of pre-formed silver halide. The use of sensitizing dyes for the silver halide is particularly desirable. These dyes can be used to match the spectral response of the emulsions to the spectral emissions of intensifier screens. It is particularly useful to use J-banding dyes to sensitive the emulsion as disclosed in U.S. Pat. No. 4,476,220.

The reducing agent for silver ion may be any material, preferably organic material, which will reduce silver ion to metallic silver. Conventional photographic developers such as phenidone, hydroquinones, and catechol are useful, but hindered phenol reducing agents are preferred. The reducing agent should be present as 1 to 20 percent by weight of the imaging particle. In a two-layer construction, if the reducing agent is in the second layer, slightly higher proportions, of from about 2 to 20 percent tend to be more desirable.

Toners such as phthalazinone, phthalazine and phthalic acid alone or in combination with other compounds are not essential to the construction, but are highly desirable. These materials may be present, for example, in amounts of from 0.2 to 5 percent by weight.

The binder may be selected from any of the well-known natural and synthetic resins such as gelatin, polyvinyl acetals, polyvinyl chloride, polyvinyl acetate, cellulose acetate, polyolefins, polyesters, polystyrene, polyacrylonitrile, polycarbonates, and the like. Copolymers and terpolymers are, of course, included in these definitions. The polyvinyl acetals, such as polyvinyl butyral and polyvinyl formal, and vinyl copolymers, such as polyvinyl acetate/chloride are particularly desirable. The binders are generally used in a range of from 20 to 75 percent by weight of the silver containing layer, and preferably about 30 to 55 percent by weight.

In describing materials useful according to the present invention, the use of the term "group" to characterize a class, such as alkyl group, indicates that substitution of the species of that class is anticipated and included within that description. For example, alkyl group includes hydroxy, halogen, ether, nitro, aryl and carboxy substitution while alkyl moiety or alkyl radical includes only unsubstituted alkyl.

As previously noted, various other adjuvants may be added to the photothermographic layer of the present invention. For example, toners, accelerators, acutance dyes, sensitizers, stabilizers, surfactants, lubricants, coating aids, antifoggants, leuco dyes, chelating agents, binder crosslinking agents, and various other well-known additives may be usefully incorporated in the layers. The use of acutance dyes matched to the spectral emission of an intensifying screen is particularly desirable.

It has also been found in the practice of the present invention that the direct addition of halogen molecules into the emulsion prior to coating on a substrate tends to further improve fog and stability in the emulsion. The halogen molecule may be molecular chlorine ($Cl_2$), bromine ($Br_2$) or iodine ($I_2$), as well as IBr, ICl, BrCl, and like molecular halogen compounds. These molecular halogens may generally be used in amounts between 0.001 and 0.1 moles molecular halogen per mole of silver in the emulsion.

EXAMPLES 1-5

A silver behenate dispersion was first prepared by homogenizing 150 g of a silver behenate half soap (converted to 14% silver by weight) and 850 g acetone. A photothermographic emulsion was prepared by using 150 g of the dispersion with the following ingredients, each added in its listed order with mixing:

56.0 g toluene
10.0 g acetone
0.30 g (polyvinylbutyral) B-76
2.0 ml of ZnBr: solution (10 g $ZnBr_2$ per 100 ml of methanol)

The mixture was held for 4 hours. To this was added:

28.8 g (polyvinylbutyral) B-76
7.5 g 1,1-bis(1-hydroxy-3-terbutyl-2-phenyl)hexane
2.0 ml Lith 421 sensitizing dye (0.26 g dye/100 ml methanol)

The resulting composition was first coated on paper or opaque polyester by means of a knife coater. A dry coating weight of 11 g/m$^2$ was applied.

An active, protective top coat solution was prepared with the following ingredients:

51.5 g acetone
27.5 g methyl ethyl ketone
11.1 g methanol
4.5 g cellulose acetate
0.51 g phthalazine
0.36 g 4-methyl phthalic acid
0.21 g tetrachlorophthalic acid
0.17 g phthalic anhydride The solution was coated at 0.2 g/ft$^2$ (2.15 g/m$^2$) over the first coating. Each layer was dried at 180° F. (80° C.) for three minutes. The coated material was then exposed through a continuous tone density wedge with a zenon flash at millisecond duration. After exposure, the material was processed at 250° F. (116° C.) for six seconds. The image obtained was evaluated by a densitometer. Various additions of antifoggants and stabilizers were made in the amounts indicated in Table I. These were added to the first coating in the above described article.

A. Control
B. N-iodophthalazinone (invention): 0.0460 g
C. N-bromophthalazinone: 0.0380 g
D. N-chlorophthalazinone: 0.0310 g
E. Mercuric acetate: 0.1500 g
F. N-iodophthalazinone (invention): 0.0077 g
G. (F): 0.0153 g
H. (F): 0.0307 g
I. (F): 0.0613 g
J. (F): 0.0920 g
K. (F) and mercuric acetate 0.0150 g & 0.1500 g (invention):
L. (F) and 2-(4-chlorobenzoyl) benzoic acid (invention): 0.0150 g & 0.7500 g The following sensitometric properties were found:

TABLE

| Component | Dmin | Dmax | Gamma | Speed |
|---|---|---|---|---|
| A (standard) | .26 | 1.20 | 47.5 | 100 |
| B | .15 | 1.21 | 51.7 | 97 |
| C (comparison) | .16 | 1.15 | 50.6 | 90 |
| D (comparison) | .16 | 1.14 | 51.3 | 90 |
| E (comparison) | .18 | 1.20 | 47.7 | 90 |
| F | .19 | 1.19 | 51.2 | 94 |
| G | .17 | 1.20 | 52.1 | 95 |
| H | .16 | 1.18 | 50.4 | 96 |
| I | .17 | 1.20 | 50.5 | 97 |
| J | .18 | 1.17 | 49.3 | 92 |
| K | .10 | 1.19 | 49.7 | 90 |
| L | .12 | 1.23 | 48.5 | 98 |

These chemicals show that they can be used to replace mercury without any loss in Dmin, Dmax, and contrast. These chemicals also show similar trends in preformed photothermographic material.

The amount of these n-halophthalazinone compounds typically ranges from about 0.0001 mole to 0.5000 mole and preferably from 0.001 to 0.050 mole based on the mole of the organic silver salt.

Iodophthalazinone compounds may be synthesized by techniques well known in the art. An example of such a technique is shown in Example 2 of U.S. Pat. No. 3,764,329. Corresponding derivatives may be made by proper selection of substituent groups on the phthalazinone reactant.

What is claimed is:

1. A photothermographic emulsion comprising photosensitive silver halide, silver oxidizing agent, reducing agent for silver ion, and a binder, said emulsion further comprising a compound having a central nucleus of the formula:

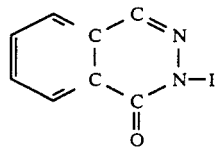

2. The emulsion of claim 1 further comprising molecular halogen.

3. The emulsion of claim 1 wherein said silver oxidizing agent comprises the silver salt of an organic carboxylic acid.

4. The emulsion of claim 3 wherein said acid has from 14 to 28 carbon atoms.

* * * * *